United States Patent [19]

Rogers

[11] Patent Number: 5,054,162

[45] Date of Patent: Oct. 8, 1991

[54] CONSTANT FORCE COMPENSATION FOR POWER SPRING WEIGHT BALANCE

[75] Inventor: Tracy G. Rogers, Rochester, N.Y.

[73] Assignee: Schlegel Corporation, Rochester, N.Y.

[21] Appl. No.: 568,829

[22] Filed: Aug. 17, 1990

[51] Int. Cl.[5] ..... E05D 13/00

[52] U.S. Cl. ..... 16/198; 16/193; 16/DIG. 16; 248/364; 242/107

[58] Field of Search ..... 16/198, DIG. 31, 193, 16/194, 196, DIG. 16; 49/445; 248/364, 334.1; 242/107, 107.4 R; 160/189, 190, 193

[56] References Cited

U.S. PATENT DOCUMENTS

| | | | |
|---|---|---|---|
| 97,263 | 11/1869 | Anderson | 16/198 |
| 132,631 | 10/1872 | Chance | 16/198 |
| 145,289 | 12/1873 | Faries | 16/198 |
| 192,680 | 7/1877 | Cashner | 16/198 |
| 198,179 | 12/1877 | Anderson | 16/198 |
| 221,247 | 11/1879 | Milner | 16/198 |
| 488,294 | 12/1892 | Smelser | 16/198 |
| 550,650 | 12/1895 | Smelser | 16/198 |
| 1,599,872 | 9/1926 | Braen | 16/198 |
| 1,669,990 | 5/1928 | Mantz | 16/198 |
| 2,010,214 | 8/1935 | Braun | 16/198 |
| 2,241,969 | 5/1941 | Tappan | 16/198 |
| 2,320,413 | 6/1943 | Cummings | 16/198 |
| 2,609,191 | 9/1952 | Foster | 267/1 |
| 2,627,082 | 2/1953 | Tappan | 16/198 |
| 2,647,743 | 8/1953 | Cook | 267/1 |
| 3,246,363 | 4/1966 | Rogas et al. | 16/78 |
| 3,335,455 | 8/1967 | Anderson | 16/198 |
| 3,445,964 | 5/1969 | Foster | 49/183 |
| 3,452,478 | 7/1969 | Foster | 49/161 |
| 3,475,865 | 11/1969 | Arnes | 49/445 |
| 4,012,008 | 3/1977 | Hosooka | 242/107 |
| 4,118,893 | 10/1978 | Becker | 49/348 |
| 4,569,490 | 2/1986 | Church | 242/107 |
| 4,914,780 | 4/1990 | Rogers | 16/193 |

*Primary Examiner*—Kurt Rowan
*Assistant Examiner*—Chuck Y. Mah
*Attorney, Agent, or Firm*—Eckert Seamans Cherin & Mellott

[57] ABSTRACT

An apparatus for offsetting a constant force over a range of movement, includes a power spring or clock spring, defined by a length of resilient material wound in a spiral, the opposite ends of which are attached relative to one of the force and a fixed point, and to a pulley. The pulley is substantially coaxial with the spring and has a rounded outer contour defining a progressively varying slope proceeding axially along the pulley. A flexible cord wraps around the pulley and leads to the other of the force and the fixed point. The opposite (inner and outer) ends of the spring can be mounted such that the inner end of the spring is fixed relative to the fixed point and the outer end of the spring is attached to the pulley. The constant force can be the weight of a window sash, movable vertically in a frame. The rounded outer contour of the pulley defines a curve corresponding to an increase in torque of the spring with displacement, due to decrease in radius of the spring and decrease in active length of the spring with binding of inner wraps of the spiral.

15 Claims, 2 Drawing Sheets

CONSTANT FORCE COMPENSATION FOR POWER SPRING WEIGHT BALANCE

BACKGROUND OF THE INVENTION

1. Field of the Invention

This invention relates to the field of force compensating apparatus, for example for offsetting the weight of a vertically movable body such as a window sash, wherein a coiled leaf spring, also known as a clock spring or "power spring," supplies a compensating force to render the body subject to the force more easily positioned within its range of movement. More particularly the invention relates to a weight compensating apparatus of this type wherein a nonlinear pulley cancels the nonlinearity of spring force vs. spring deflection that occurs due to the specific nature of the power spring.

2. Prior Art

It is well known to at least partially offset the weight of a movable body which is to be raised and lowered within a range of movement. If precisely balanced, the body remains in place when positioned, rather than tending to fall. An operator or the like need only exert the force needed to move the body from one position to another, and need not offset the weight of the body itself. To avoid the need for accommodating a counterbalancing deadweight, the weight of the body is advantageously offset with a spring. Familiar examples of spring counterbalanced weights are window sashes, garage doors, movable-panel blackboards, and supporting carriages for vertically movable equipment.

Spring force varies as a function of deflection of the spring; however, the weight of the movable body is fixed. In order to compensate for the additional force exerted by a counterbalancing spring when the spring is deflected (e.g., as a window sash is being lowered), it is known to provide a compensating pulley that converts a linearly varying spring force to a constant force. A flexible cord, cable, wire, rope or the like connects the spring and the supported weight via a conical or spiral pulley. The spiral pulley defines a radius for the cord which varies linearly with displacement of the ends of the spring, and thus defines a linearly varying moment arm to compensate for the variation in spring force over the range of movement of the body. This idea is workable for various types of springs in extension or retraction, and for various weights and other constant force exerting conditions.

The spring and compensating apparatus used to offset the weight of a window sash or the like is typically mounted in either the window frame or in the window sash, with the flexible cord attached to the other of the frame and the sash. One difficulty encountered is that the structure of the sash balance apparatus including the spring and compensating pulley, together with additional pulleys needed to route the cord along its path, can be rather large. Another difficulty is with wear on the cord and pulleys. The varying forces are such that the connecting cord and/or the pulley arrangement may wear substantially in the areas of contact at the ends of the range of deflection of the sash or other movable body. In U.S. Pat. No. 4,914,780—Rogers et al, additional elements are provided along the force transmission path, including a constant radius (cylindrical) pulley and a block and tackle force reduction mechanism, to address this problem. Such additional elements further increase the dimensions of the balance apparatus which must be housed in the window frame and/or the sash.

Rogers et al teach using a helical coil spring for producing force varying linearly with spring deflection, namely compression and extension of the spring along the central axis of the helix. This form of spring obviously requires a housing at least as long as the full extension length of the spring. A more compact form of spring is possible, wherein the spring is wound spirally in a plane. The inner end of the spring can be fixed, and the outer end can be rotated around the fixed inner end or pulled outwardly along a tangent. Similarly, the outer end can be fixed and the inner end arranged to rotate a shaft. The movable end of the spring is connected to rotate a conical pulley relative to the fixed end. This spiral form of spring, known as a power spring or clock spring, is relatively compact.

Weight balancing window sash apparatus comprising one or more power springs, i.e., springs wound spirally in a plane, and also including a conical pulley arrangement, are disclosed for example in U.S. Pat. Nos. 4,012,008—Hosooka; 1,599,872—Braen; 550,650—Smelser; 221,247—Milner; 145,289—Faries; 132,631—Chance; and, 97,263—Anderson. The spring is typically a wound steel strip or leaf, fixed at its center to the sash or the frame in which the sash is moved. The outer end of the spring is attached to a rotatable drum and a conical pulley is either attached coaxially to the drum or defined by the outer surface of the drum. As the spring is wound (or unwound), the cord is extracted from (or wound onto) the conical pulley. The point of tangent contact between the cord and the conical pulley varies axially along the conical pulley with relative rotation of the spring ends, and accordingly the effective radius of the conical pulley varies as well. The object is to provide a linearly varying moment arm by means of the conical pulley to precisely counter the varying force exerted by the spring as the spring is wound or unwound and to produce a constant force for offsetting the constant weight of the sash.

It is axiomatic that the force exerted by a resilient structure defining a spring in extension or compression varies linearly with the relative displacement of the ends of the spring. The same is true of torsional (twisting) displacement of the ends of a resilient body. According to the foregoing patents, wherein the pulley carrying the cord is conical, a linear relationship or "spring constant" is assumed for the spring as a whole, with the spring force compensated in an amount directly proportional to displacement.

However, in a power spring, the force exerted by the spring as a whole is not linear, i.e., not directly proportional to displacement. The effectiveness of known power spring balances is thus limited. Various modifications of power spring apparatus have been suggested to improve operation, but persons skilled in the art have continued to assume that a power spring should be compensated in the same manner as an extension spring.

SUMMARY OF THE INVENTION

It is an object of the invention to balance a movable weight such as a window sash as precisely as possible, using a compact, inexpensive and durable apparatus.

It is a further object of the invention to improve upon the known power spring balance having a power spring in a drum attached to a conical pulley, in a manner that corrects for specific physical attributes of a power spring.

It is another object of the invention to provide, in a power spring balance, a compensating pulley that has a nonlinear contour reflecting a decreasing spring constant with deflection of the spring.

These and other objects are accomplished by an apparatus for offsetting a constant force over a range of movement, including a spring defined by a length of resilient material wound in a spiral with opposite ends, the opposite ends being fixed, respectively, relative to one of a point of attachment to the force and a fixed point, and relative to a pulley. The pulley is substantially coaxial with the spring and has a rounded outer contour defining a progressively varying slope proceeding axially along the pulley. A flexible connection member or cord leading to the other of the point of attachment to the force and the fixed point is wound on the rounded outer contour of the pulley. The opposite ends of the spring, in particular an inner end and an outer end, are mounted such that the inner end of the spring is fixed relative to the fixed point and the outer end of the spring is attached to the pulley. The constant force can be the weight of a sash, movable vertically in a frame.

The rounded outer contour of the pulley defines a curve corresponding to a decrease in torque of the spring provided by at least one of decrease in radius of the spring and decrease in active length of the spring with binding of inner wraps of the spiral, as the opposite ends of the spring are rotationally displaced. The rounded outer contour can define, in cross section, an arc of a circle, defined by the equation:

$$\%T_{max} = 1 - (\%U - 1)^2$$

where $\%T_{max}$ is the percentage of maximum torque of the spring and %U is the percentage of deflection of the spring within an operating range. The pulley in cross section has concave surfaces around which the cord wraps.

BRIEF DESCRIPTION OF THE DRAWINGS

The drawings illustrate presently preferred exemplary embodiments of the invention. However, the invention is not limited to the exemplary embodiments, and is capable of other arrangements and groupings of elements in accordance with the claims. In the drawings:

DETAILED DESCRIPTION OF THE PREFERRED EMBODIMENTS

Figure 1:
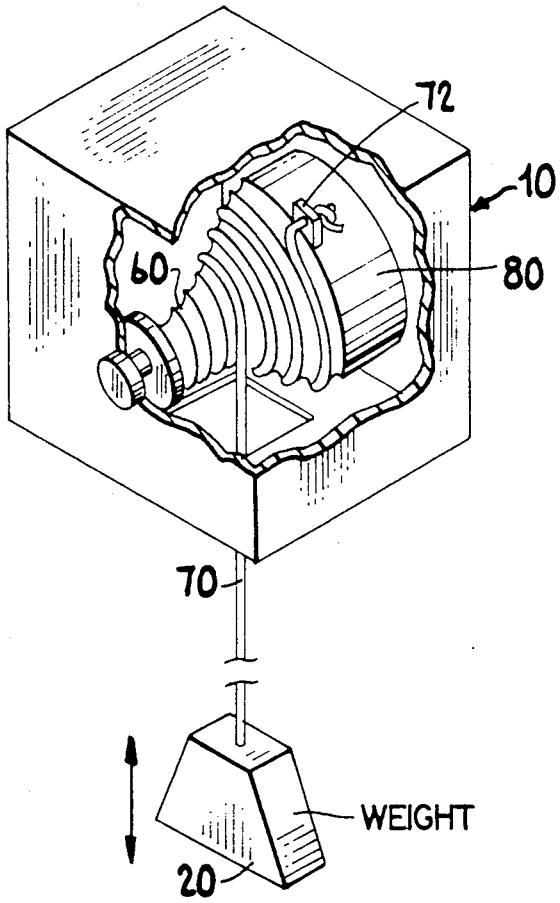
FIG. 1 is a cut away perspective view of a constant force compensation apparatus according to the invention.
Figure 2:
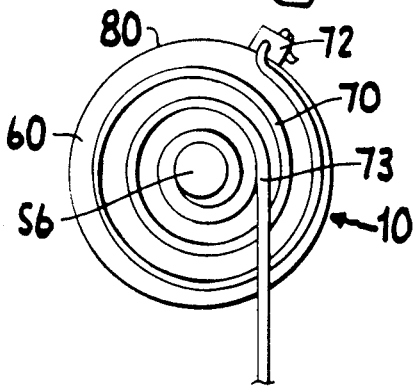
FIG. 2 is an elevation view thereof, showing the pulley apart from the housing.
Figure 3:
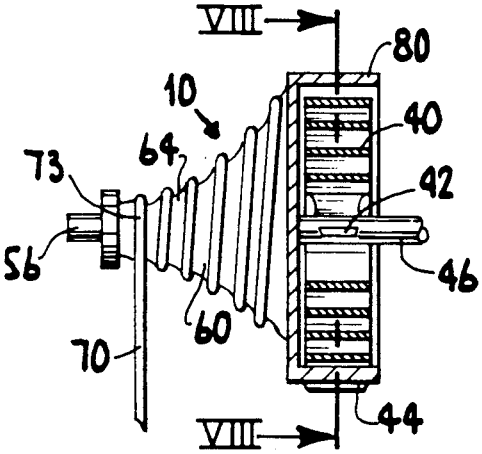
FIG. 3 is a partially cut away elevation view, at minimum spring deflection (e.g., with the sash raised)
Figure 4:
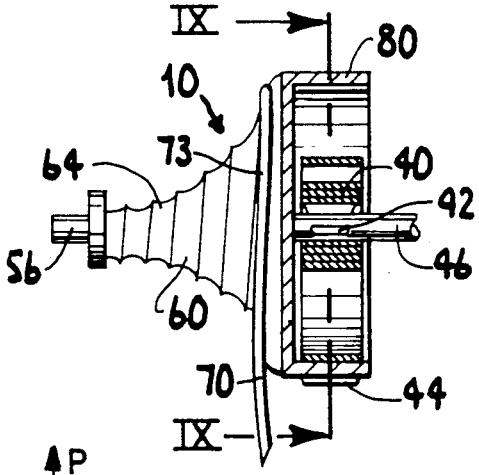
FIG. 4 is a partially cut away elevation view, at maximum spring deflection (with the sash lowered)

A force compensating apparatus 10 according to the invention as shown in FIGS. 1-4 converts a varying force exerted torsionally by a spiral wound spring housed in drum 80 to a constant force. The constant force may be applied as shown to counter the constant force on a movable body 20 resulting from gravity. Body 20 is shown generally as a weight, and can represent a window sash or other movable element subject to a constant force. The spring is mounted and biased to exert a torque on the drum 80, and a particularly shaped pulley 60 is attached to the drum 80. A flexible cord 70 is attached to the body 20 at one end and attached to the apparatus 10 at the other end. The cord 70 wraps around pulley 60 between a point of attachment 72 and a point 73 at which the cord passes tangentially from the pulley to the load. As the pulley rotates, rotationally deflecting the spring, the point 73 at which the cord joins the pulley moves axially along the pulley. The pulley is shaped such that the diameter of the pulley is larger at the point where the cord meets the pulley, when the deflection of the spring is greatest and spring force is thereby maximum. The pulley diameter is smaller where the cord meets the pulley when the spring force is less due to less deflection of the spring. The tensile force exerted on the cord 70 by the apparatus 10 is equal to the torque divided by the radius or moment arm length. The contour of the pulley progressing axially along the pulley is chosen such that the force exerted on the cord 70 remains constant, and thus balances the weight of body 20, even though the force developed by the spring in drum 80 varies nonlinearly over the range of deflection of the spring.

Figure 5:
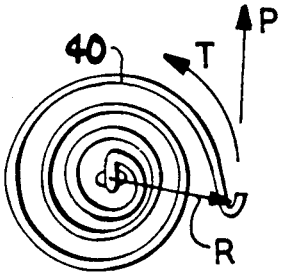
FIG. 5 is a schematic elevation view of a power spring.
Figure 6:
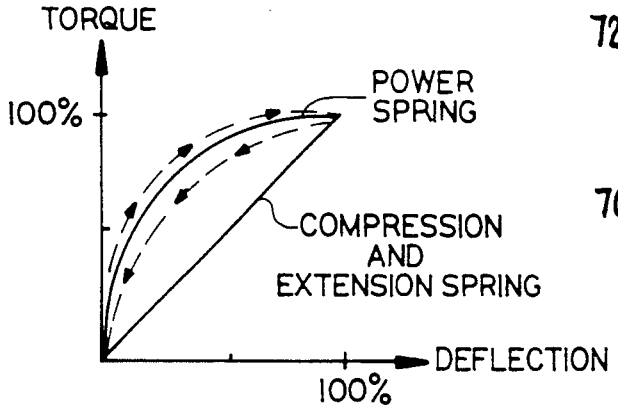
FIG. 6 is a graph showing the torque vs. deflection characteristic of a power spring without compensation.
Figure 10:
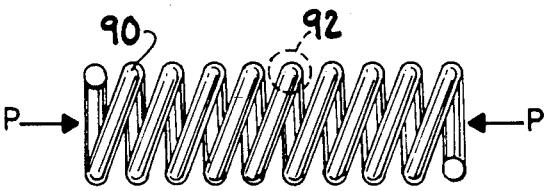
FIG. 10 is an elevation view of a compression/extension spring.
Figure 11:
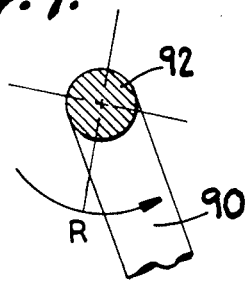
FIG. 11 is a partial longitudinal section view through the spring of FIG. 10.

The characteristic force exerted by a spirally wound spring or "power spring" 40 as shown schematically in FIGS. 5 and 6 differs from the characteristic force of a compression/extension spring 90, shown in FIGS. 10 and 11. With a compression/extension spring, the force exerted by the spring is linear, i.e. directly proportional to the extension or compression of the ends of the spring from a rest position. In the helical spring of FIGS. 10 and 11, the energy produced for example upon compression of the spring by force P is stored in torsion of the spring material at each incremental point around an internal helical line defined by the spring material. At every point along the helix, for example at the point 92 shown in FIG. 11, the elasticity of the spring material produces torsional force R, which resists the axial force P, allowing energy to be accumulated in the spring. All the incremental sections along the spring are deflected by an incremental amount as a result of inward force P, each section contributing to the overall force, and there is no interference between loops of the helix unless the spring is compressed to the point that the helical loops abut. Assuming that the force is not sufficient to abut the coils (or to exceed the range of elasticity of the spring material in compression or extension), the spring produces a linearly varying force/deflection characteristic at all points of deflection.

Power springs (also known as clock springs or spiral springs) on the other hand, store energy due to the bending of the resilient material along the cross sectional axis of the material. With reference to FIG. 5, the power spring produces a torque T, which at a radius R from the central axis of rotation of the spring translates into a linear force P along a tangent, according to the relationship $T=P\times R$. This torque is related to the physical attributes of the spring by the equation:

$$T = \frac{U\pi Et^3}{6L}$$

Where U is the rotational deflection of the spring; E is the tension modulus of elasticity; t is the material thickness; and L is the active length of the spring. The torque results from energy stored in bending of the incremental sections of the spring, but not in a manner independent of the extent of deflection, as is true of compression/extension springs.

Figure 8:
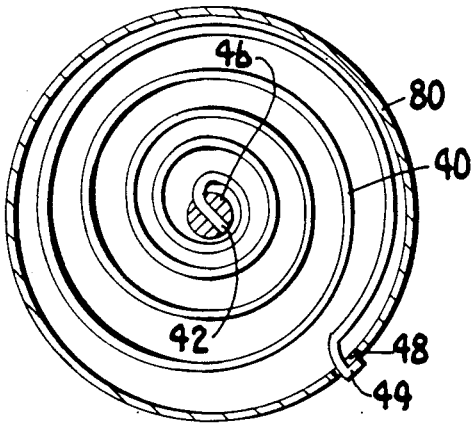
FIG. 8 is a section view taken along lines 8—8 in FIG. 3, showing the spring at zero deflection.
Figure 9:
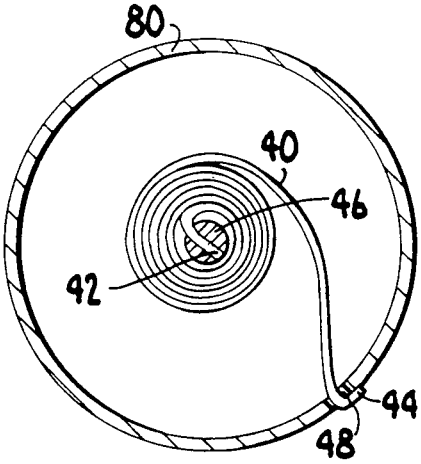
FIG. 9 is a section view taken along lines 9—9 in FIG. 4, showing the spring at substantially full deflection.

As a power spring is deflected between its no-load rest condition (FIGS. 3 and 8) and full deflection (FIGS. 4 and 9) by relative rotation of the inner and outer ends, two things occur which affect the torque developed by bending of the incremental sections. The mean radius for all the incremental sections at which force P is developed decreases because the inner end of the spring is fixed and deflection winds the spring material inwardly. In addition, the active length of the spring decreases, because with progressively greater constriction, the inner wraps of the spring increasingly bear against one another and interfere. With sufficient constriction inner wraps become wholly inactive for producing additional torque with further deflection. As deflection proceeds, more and more of the length of the spring becomes inactive in a manner similar to abutment of the helical loops of an extension spring, but proceeding from the inner wraps outward. A similar effect occurs with reverse deflection of the power spring, where deflection moves the mean radius outwardly and more and more of the wraps abut one another outwardly against the inner surface of drum 80, which encloses the spring.

The precise degradation of the ability of the spring to produce additional torque with additional deflection is not readily quantified as it depends to some extent on the surface characteristics of the spring material. Empirical analysis has shown that as a result of the foregoing variables, a power spring produces a torque vs. deflection curve substantially as shown in FIG. 6. The relationship is curvilinear, and according to an approximation may be defined as a circular arc over 90°. The equation for a circle, namely $r^2=x^2+y^2$, can be applied to define a torque vs. deflection relationship of:

$$\%T_{max}=1-(\%U-1)^2$$

Where $\%T_{max}$ is the percentage along the range from zero to maximum torque, and %U is the percentage along the corresponding range of deflection. According to the invention, this relationship is reflected by the contour of rounded pulley 60, to match the characteristic torque/deflection curve of the power spring and to provide a substantially constant force P throughout the operative range of the counterbalance apparatus.

Another attribute of a power spring or clock spring is that the amount of torque supplied is different when the spring is operating in the extending and retracting modes. The spring has a certain hysteresis as shown in broken lines in FIG. 6. While the rounded contour pulley of the invention does not provide means to vary operation in the extension and retraction modes, the contour of the pulley can be arranged to reflect the average of the torque in the extension and retraction modes, thereby approximating the variation in force due to the nature of the spring, and compensating therefor in a manner substantially more effective than a conical (linear) pulley.

The average torque is estimated to be a curvilinear relationship which circumscribes a quarter circle between the boundaries of zero and 100% of total torque and deflection. The derivation which emulates this relationship is described by the following equations:

$$\theta_1 = \theta_{max}\left(1 - \sqrt{1 - c\,(r(0) + r_c)^2}\right) - \theta_i \qquad (1)$$

where $$c = \frac{1}{(r_o + r_c)^2}$$

and, $$\theta_{max} = \frac{2L}{(r_o + r_i + 2r_c)\sqrt{1 - c\,(r_i + r_c)^2}} \qquad (2)$$

For these relationships, $\theta_l$=rotational position of spiral as a function of spiral radius;

$\eta_{max}$=maximum rotational deflection of spring;

$\theta_i$=initial rotational deflection of spring at $\theta_l=0$;

$r_o$=outer radius of spiral;

$r_i$=inner radius of spiral;

$r_c$=outer radius of cord or cable;

L=required length of spiral.

A system which uses the foregoing design to offset a force operating between two points of reference is shown in FIGS. 1–4. The power spring or clock spring is mounted inside the cup or drum 80, and is fixed by one end 44 at a slot 48 in drum 80 and by the other end 42 to a fixed point (e.g., via a slot in nonrotatable shaft 46, or to a fixed point on the rear of the housing). As the spring/drum assembly rotates, the torque produced by the spring increases at a function of rotation approximately as shown in FIG. 6. This torque is translated into a relatively constant force applied to the load by the spiral contour of the pulley surface which bears the connecting cord, this contour being in accordance with foregoing equations (1) and (2).

The invention is therefore an apparatus 10 for offsetting a constant force operating between two points of reference over a range of movement, comprising a spring 40 of the power spring or clock spring variety, having a length of resilient material wound in a spiral and defining opposite ends 42, 44. The apparatus 10 can be mounted at a fixed position relative to the load 20 or a fixed position relative to the range in which the load is to be moved. Similarly, either end of the spring can be fixed, while allowing the other end to rotate. Accordingly, means 46, 48 are provided for fixing one of the opposite ends 42, 44 of the spring 40 relative to either a point of attachment to the load or similar force or to a fixed point (these defining the two points of reference). A pulley 60 is attached to the other of the opposite ends of the spring. The pulley 60 is substantially coaxial with the spring 40 and has a rounded outer contour 64 defining a slope which varies with axial displacement on the pulley; i.e., the contour is curved in cross section, comparable to the shape of the graph in FIG. 6. The pulley provides a means 72 for attachment of a flexible connection member 70 such as a cord or cable knotted at means 72 and leading to the other point of reference, i.e., to the other of the point of attachment to the load or the fixed point such that the flexible connection member 70 is windable on the rounded outer contour 64 of the pulley 60. As the torque exerted by the spring increases with rotation increasing the extent of spring deflection, the connection member 70 advances axially toward the larger radius end of the pulley 60 as in FIG. 4, where the spring is shown fully deflected. As the torque of the spring decreases with rotation in the opposite direction, the connection member advances axially toward the smaller radius end as in FIG. 3. In this manner, the radius between the axis of rotation 56 and the tangent 73 from which the connection member 70 extends is made to vary with rotation of the pulley 60 and with deflection of the spring 40. The torque of the spring and the length of the moment arm defined by this radius vary with rotation in inverse proportion to one another such that the division of the torque and the moment arm remain substantially constant, thereby exerting a substantially constant force along the connection member 70. The constant force can be arranged to be nearly equal to the weight of the load 20, such that the operator need only exert sufficient force to overcome the difference between the weight of the load and the force exerted by the apparatus 10 when moving the load up or down.

In the embodiment shown, the apparatus 10 is mounted to a fixed point (rather than to the movable load). Also in this embodiment, the inner end 42 of the spring 40 is fixed relative to the fixed point and the outer end 44 of the spring 40 is attached to the pulley 60. Therefore, the outer end 44 rotates around the inner end 42. It is also possible to reverse the sense of these connections, e.g. by attaching the outer end 44 of the spring to the fixed point and allowing the inner end 42 to rotate within it. In that case, the pulley 60 would be fixed to the inner end of the spring 40, for example with axial shaft 46 being rotatably mounted relative to the housing and nonrotatably fixed to pulley 60.

The rounded outer contour 64 of the pulley 60 defines a curve corresponding to an increase in torque of the spring 40 provided by at least one of decrease in radius of the spring and decrease in active length of the spring with binding of inner wraps of the spiral, as the opposite ends of the spring are rotationally displaced. The curve of the pulley substantially defines an arc of a circle, and can be defined by the equation:

$$\%T_{max} = 1 - (\%U - 1)^2$$

where $\%T_{max}$ is the percentage of maximum torque of the spring and %U is the percentage of deflection of the spring within an operating range.

Figure 7:
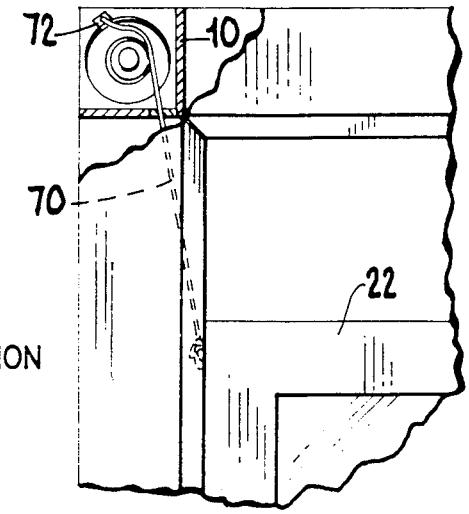
FIG. 7 is an elevation view of the invention as applied to a window sash.

The device of the invention can be used to offset any constant force using a power spring. However, an advantageous use is as a counterbalance for offsetting the weight of a body 20 movable vertically relative to a fixed point. There are many examples of such applications, for example vertically movable closure panels such as in windows, garage doors and the like, vertically positionable machines and equipment, and others. FIG. 7 illustrates the invention as applied to balance a window sash 22 which is mounted for vertical movement in a frame 30. As discussed above, a spring 40 of the power spring or clock spring variety, namely having a length of resilient material wound in a spiral and defining opposite ends, produces torque applied to produce a vertically upward substantially constant force. One of the opposite ends of the spring, such as the inner end 42, is fixed relative to one of the sash 22 and the frame 30, and the other end is attached to a pulley 60 having a rounded outer contour as described. The apparatus can be mounted in the frame 30 as shown, or in the sash 22. The flexible connection cord or cable 70 attaches the other of the frame or sash, and wraps around the pulley 60 to provide a moment arm that varies with rotation of the pulley in an amount that as nearly as practicable cancels the weight of the sash. The counterbalance apparatus is compact and effective.

The flexible connection cord can be made of any material durable enough to withstand the forces and the number of expected cycles. In a window sash embodiment, a Dacron polyester cord can be used, preferably with a minimum static load safety factor of 5:1. The cord, spring and pulley should be durable in view of the expected life cycle of 15,000 to 20,000 operations, over which life cycle consistent operation is desirable.

It is possible to vary the mechanical advantage of force transmission between the spring and the sash. For example, one or more additional pulleys (not shown) defining a reduction block can be incorporated to convert a relatively longer travel at lower force to a relatively shorter travel at higher force, or vice versa. The exemplary embodiment shown, which does not include such a reduction block, is apt for a typical window sash weight range of 5 to 40 lbs. (about 2 to 20 kg.). However, the apparatus can be applied to any weight to be offset, using either or both of changes in the overall scale and the use of reduction blocks. The device can be used with wood, metal, plastic or composite window sashes, or in fact any window sash or other constant load including but not limited to a vertically movable weight.

The invention having been disclosed, a number of alternatives and variations on the inventive concept will become apparent to persons skilled in the art. Reference should be made to the appended claims rather than the foregoing specification to assess the scope of the invention in which exclusive rights are claimed.

I claim:

1. A counterbalance apparatus for offsetting a constant force between two points of reference, over a range of movement, the points of reference respectively defining a point of attachment to the force and a fixed point, the apparatus comprising:

a spring having a length of resilient material wound in a spiral and defining opposite ends;

means for fixing one of the opposite ends of the spring relative to one of the points of reference;

a pulley attached to the other of the opposite ends of the spring, the pulley being substantially coaxial with the spring and having a rounded outer contour defining a progressively varying slope proceeding axially along the pulley, the pulley providing means for attachment of an end of a flexible connection member which leads to the other of the points of reference, such that the flexible connection member is windable on the rounded outer contour of the pulley.

2. The apparatus according to claim 1, wherein the opposite ends of the spring are an inner end and an outer end, and wherein the inner end of the spring is fixed relative to the fixed point and the outer end of the spring is attached to the pulley.

3. The apparatus according to claim 1, wherein the rounded outer contour of the pulley defines a curve corresponding to an increase in torque of the spring provided by at least one of decrease in radius of the spring and decrease in active length of the spring with binding of inner wraps of the spiral, as the opposite ends of the spring are rotationally displaced.

4. The apparatus according to claim 3, wherein the curve of the rounded outer contour of the pulley substantially defines an arc of a circle.

5. The apparatus according to claim 4, wherein the curve is defined by the equation:

$$\%T_{max}=1-(\%U-1)^2$$

where $\%T_{max}$ is the percentage of maximum torque of the spring and %U is the percentage of deflection of the spring within an operating range.

6. A counterbalance apparatus for offsetting the weight of a body movable vertically relative to a fixed point, the body and the fixed point defining two points of reference, the counterbalance, comprising:

a spring having a length of resilient material wound in a spiral and defining opposite ends;

means for fixing one of the opposite ends of the spring relative to one of the points of reference;

a pulley attached to the other of the opposite ends of the spring, the pulley being substantially coaxial with the spring and having a rounded outer contour defining a progressively varying slope proceeding axially along the pulley; and, a flexible connection member attached at one end to the pulley, and windable on the rounded outer contour of the pulley, the flexible connection member leading from the pulley to the other of the points of reference.

7. The apparatus according to claim 6, wherein the opposite ends of the spring are an inner end and an outer end, and wherein the inner end of the spring is fixed relative to the fixed point and the outer end of the spring is attached to the pulley.

8. The apparatus according to claim 6, wherein the rounded outer contour of the pulley defines a curve corresponding to an increase in torque of the spring provided by at least one of decrease in radius of the spring and decrease in active length of the spring with binding of inner wraps of the spiral, as the opposite ends of the spring are rotationally displaced.

9. The apparatus according to claim 8, wherein the curve of the rounded outer contour of the pulley substantially defines an arc of a circle.

10. The apparatus according to claim 9, wherein the curve is defined by the equation:

$$\%T_{max}=1-(\%U-1)^2$$

where $\%T_{max}$ is the percentage of maximum torque of the spring and %U is the percentage of deflection of the spring within an operating range.

11. A sash apparatus, comprising:

a sash mounted for vertical movement in a frame;

a spring having a length of resilient material wound in a spiral and defining opposite ends;

means for fixing one of the opposite ends of the spring relative to one of the sash and the frame;

a pulley attached to the other of the opposite ends of the spring, the pulley being substantially coaxial with the spring and having a rounded outer contour defining a progressively varying slope proceeding axially along the pulley; and, a flexible connection member attached at one end to the pulley, and windable on the rounded outer contour of the pulley, the flexible connection member leading from the pulley to the other of the sash and the frame.

12. The apparatus according to claim 11, wherein the opposite ends of the spring are an inner end and an outer end, and wherein the inner end of the spring is fixed relative to the frame and the outer end of the spring is attached to the pulley.

13. The apparatus according to claim 11, wherein the rounded outer contour of the pulley defines a curve corresponding to an increase in torque of the spring provided by at least one of decrease in radius of the spring and decrease in active length of the spring with binding of inner wraps of the spiral, as the opposite ends of the spring are rotationally displaced.

14. The apparatus according to claim 13, wherein the curve of the rounded outer contour of the pulley substantially defines an arc of a circle.

15. The apparatus according to claim 14, wherein the curve is defined by the equation:

$$\%T_{max}=1-(\%U-1)^2$$

where $\%T_{max}$ is the percentage of maximum torque of the spring and %U is the percentage of deflection of the spring within an operating range.

* * * * *